US006161088A

United States Patent [19]

Li et al.

[11] Patent Number: 6,161,088

[45] Date of Patent: Dec. 12, 2000

[54] METHOD AND SYSTEM FOR ENCODING A DIGITAL AUDIO SIGNAL

[75] Inventors: Hsiao Yi Li, Garland; Jonathan L Rowlands, Dallas, both of Tex.

[73] Assignee: Texas Instruments Incorporated, Dallas, Tex.

[21] Appl. No.: 09/105,906

[22] Filed: Jun. 26, 1998

[51] Int. Cl.[7] ..... G10L 19/02

[52] U.S. Cl. ..... 704/229; 704/205; 704/501; 704/230; 704/226

[58] Field of Search ..... 704/206, 205, 704/209, 229, 226, 230, 500–504; 375/216, 241; 348/484; 364/725

[56] References Cited

U.S. PATENT DOCUMENTS

| | | | |
|---|---|---|---|
| 5,285,498 | 2/1994 | Johnston | 704/500 |
| 5,463,424 | 10/1995 | Dressler | 348/485 |
| 5,481,614 | 1/1996 | Johnston | 704/500 |
| 5,508,949 | 4/1996 | Konstantinides | 364/725 |
| 5,625,743 | 4/1997 | Fiocca | 704/205 |
| 5,627,937 | 5/1997 | Kim | 704/229 |
| 5,627,938 | 5/1997 | Johnston | 704/230 |
| 5,633,981 | 5/1997 | Davis | 704/230 |
| 5,649,052 | 7/1997 | Kim | 704/226 |
| 5,687,191 | 11/1997 | Lee et al. | 375/216 |
| 5,737,721 | 4/1998 | Kwon | 704/229 |
| 5,764,698 | 6/1998 | Sudharsanan et al. | 375/241 |
| 5,852,806 | 12/1998 | Johnston et al. | 704/500 |
| 5,864,813 | 1/1999 | Case | 704/500 |
| 5,864,820 | 1/1999 | Case | 704/278 |
| 5,999,899 | 12/1999 | Robinson | 704/222 |

OTHER PUBLICATIONS

R.G. van der Waal et al., ("Current and future standardization of high–quality digital audio coding", Applications of Signal Processing to Audio and Acoustics'93, IEEE Workshop on Final Program Paper Summaries., Jan. 1993, pp. 43–46).

Brandenburg et al., (Comparsion of filterbanks for high quality audio coding, Proceedings., 1992 IEEE International Symposium on Circuits and Systems, ISCAS, '92, vol. 3, pp. 1336–1339), Jan. 1992.

Coding of Moving Pictures and Associated Audio for Digital Storage Media at up to About 1.5 MBIT/s (Part 3 Audio), Nov. 1993/Printed Oct. 1, 1996, CD 11172–3 rev (1, 168 pages).

*Primary Examiner*—David R. Hudspeth
*Assistant Examiner*—Vijay B Chawan
*Attorney, Agent, or Firm*—Robert D. Marshall, Jr.; W. James Brady, III; Frederick J. Telecky, Jr.

[57] ABSTRACT

A method for encoding a digital audio signal includes filtering a portion of the digital audio signal into a first number of frequency ranges to produce a respective first number of filtered signals and performing a discrete frequency analysis on each of the first number of filtered signals to produce a frequency representation of the digital audio signal. The method also includes generating a psychoacoustic representation of the portion of the digital audio signal based on the frequency representation of the digital audio signal and formatting the first number of filtered signals based on the psychoacoustic representation of the portion of the digital audio signal to produce a digitally-compressed encoded bit stream representing the portion of the digital audio signal.

6 Claims, 2 Drawing Sheets

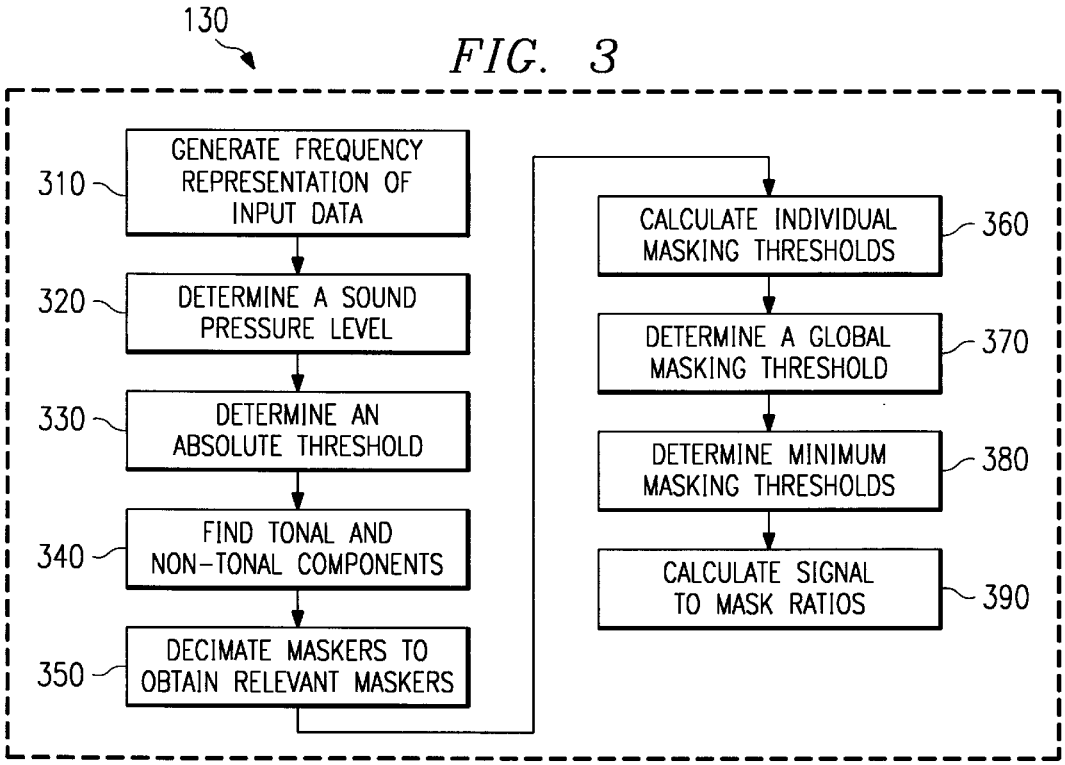
130
FIG. 3
310
GENERATE FREQUENCY REPRESENTATION OF INPUT DATA
320
DETERMINE A SOUND PRESSURE LEVEL
330
DETERMINE AN ABSOLUTE THRESHOLD
340
FIND TONAL AND NON-TONAL COMPONENTS
350
DECIMATE MASKERS TO OBTAIN RELEVANT MASKERS
CALCULATE INDIVIDUAL MASKING THRESHOLDS
360
DETERMINE A GLOBAL MASKING THRESHOLD
370
DETERMINE MINIMUM MASKING THRESHOLDS
380
CALCULATE SIGNAL TO MASK RATIOS
390

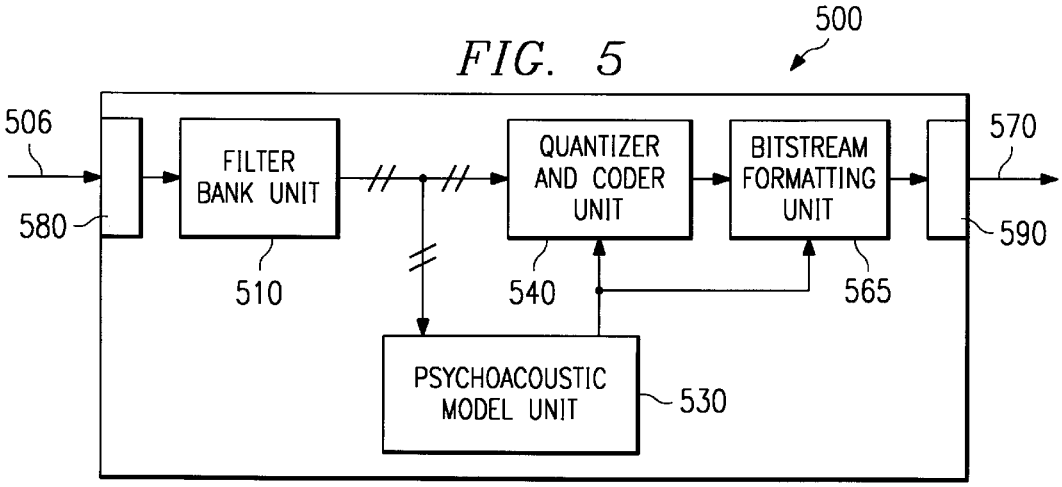
500
FIG. 5
506
580
FILTER BANK UNIT
510
QUANTIZER AND CODER UNIT
540
BITSTREAM FORMATTING UNIT
565
570
590
PSYCHOACOUSTIC MODEL UNIT
530

METHOD AND SYSTEM FOR ENCODING A DIGITAL AUDIO SIGNAL

RELATED APPLICATIONS

This application is related to a provisional application having a title of "Method for Computing Masking Thresholds in Digital Audio Encoded Signal," filed Jun. 14, 1996, having and a serial number of Ser. No. 60/019,907 now U.S. patent application Ser. No. 08/855,118 filed May 13, 1997 and now abandoned, having a Japanese convention application no. 157,156/97 filed Jun. 13, 1997 now Japanese Laid-open number 107,642/98 laid open Apr. 28, 1998.

TECHNICAL FIELD OF THE INVENTION

This invention relates generally to digital communications and more particularly to an efficient psychoacoustic encoding method and system for encoding digital audio signals.

BACKGROUND OF THE INVENTION

Pulse code modulation (PCM) is typically used for broadcasting digital audio signals. In order to more efficiently broadcast or record digital audio signals, the amount of digital information needed to reproduce the PCM-coded samples can be reduced by using a digital compression algorithm to produce a digitally-compressed representation of the original signal. Digital compression is useful wherever bandwidth is limited and there is an economic benefit to be realized by reducing the amount of information being passed at any time. For example, digital compression is typically used for high quality audio transmissions in video conferencing systems, satellite or terrestrial audio broadcasting systems, coaxial or optical cable audio transmission systems, and for storing audio signals on magnetic, optical and semiconductor storage devices. A standard digital audio encoded signal format has been set forth by the Motion Picture Experts Group (see, for example, ISO/IEC 11172-3 and ISO/IEC 13818-3). This format is commonly referred to as "MPEG Audio."

The term "psychoacoustics" relates to the field of sound as it is perceived by humans. According to psychoacoustic theory, certain sounds cannot be perceived, or perceived as accurately, as other sounds. Therefore, in compressing a digital representation of an audio signal, one may capitalize on this information and allocate more bits of data to represent the sounds that a human ear can more readily perceive and allocate less bits of data to represent the sounds that a human ear can less readily perceive.

Two primary aspects of psychoacoustics enable representation of an audio signal with less bits of data than would otherwise be necessary. These two aspects are quantization and masking. With respect to quantization, psychoacoustic theory recognizes that, within the range of perception of the human ear, the human ear is more sensitive to lower frequencies than to higher frequencies. Therefore, it has been recognized that higher frequencies of an audio signal may be represented with less bits of data than lower frequencies of an audio frequency without significant diminution in sound quality.

With respect to masking, when a person hears an audio signal (e.g., music), certain tones are perceived to overpower or "mask" other tones in the signal. In the digital signal processing field, frequency domain "masking" is a phenomenon that occurs whereby a tone or narrowband noise signal at one frequency affects the sensitivity of the ear to a tone or noise signal at a different frequency. The higher power or dominant signal is typically called the "masking tone," and a lower power or subservient signal is typically called a "masked tone." One method for determining which tones in a signal are masked is described in a co-pending application with having a title of "Method For Computing Masking Thresholds in Digital Audio Encoded Signals," filed Jun. 14, 1996, having a serial number of Ser. No. 60/019,907 now U.S. patent application Ser. No. 08/855,118 filed May 13, 1997 and now abandoned, having a Japanese convention application no. 157,156/97 filed Jun. 13, 1997 now Japanese Laid-open number 107,642/98 laid open Apr. 28, 1998. Tones that are masked may be omitted in a digital representation of the original audio signal without significant diminution of sound quality. In addition, tones that are partially masked may be represented by fewer bits of data than tones that are not masked. Therefore, a digital audio signal may be compressed by omitting masked tones and representing some tones with fewer bits of data than other tones.

In order to determine which tones are masked in the digital audio signal and to appropriately allocate the number of bits used to represent various frequencies in the digital audio signal, MPEG standards require a frequency representation of the digital audio signal. Conventionally, a frequency analysis of the digital audio signal is obtained through performing either a 512 point or a 1024 point fast Fourier transform on the digital audio signal. However, the number of calculations required to perform a fast Fourier transform is proportional to N log( N), where N is the number of points used for the fast Fourier transform. Performing such a transform may therefore require a large number of calculations and may slow the encoding process.

SUMMARY OF THE INVENTION

Therefore a need has arisen for an efficient psychoacoustic encoding method and system for encoding digital audio signals that address the disadvantages and deficiencies of prior systems and methods. The invention includes a method and system for efficiently encoding digital audio signals according to a psychoacoustic model.

According to one aspect of the invention, a method for encoding a digital audio signal according to psychoacoustic principles includes filtering a portion of the digital audio signal into a first number of frequency ranges to produce a respective first number of filtered signals and performing a discrete frequency analysis on each of the first number of filtered signals to produce a frequency representation of the digital audio signal. The method also includes generating a psychoacoustic representation of the portion of the digital audio signal based on the frequency representation of the digital audio signal and formatting the first number of filtered signals based on the psychoacoustic representation of the portion of the digital audio signal to produce a digitally-compressed encoded bit stream representing a portion of the digital audio signal.

According to another aspect of the invention, a digital signal processor for encoding digital audio input includes a central processing unit and a memory system accessible by the central processing unit. The memory system stores encoding programming operable to be executed by the central processing unit. The encoding programming is operable to filter a portion of the digital audio input into a first number of frequency ranges to produce a respective first number of filtered signals and perform a discrete frequency analysis on each of the first number of filtered signals to produce a frequency representation for the digital audio input. The encoding programming is further operable to generate a psychoacoustic representation of the portion of the digital audio input based on the frequency representation of the digital audio input and format the first number of filtered signals based on the psychoacoustic representation to produce a digitally-compressed encoded bit stream representing a portion of the digital audio input.

The invention provides several technical advantages. For example, according to the invention a frequency analysis may be performed for use in generating a psychoacoustic model with fewer calculations than conventional methods. Because fewer calculations are required, the digital input may be encoded faster.

In addition, according to the invention, a variable number of points may be used for each frequency range on which a frequency analysis is performed to further reduce the number of calculations, further reducing the speed required to encode a digital audio signal. The ability to vary the number of points used for each frequency range allows for a variable frequency resolution depending on frequency. Because the human ear is less sensitive to higher frequencies than to lower frequencies, less resolution is required at higher frequencies, and therefore, with a variable number of points used for the frequency analysis of each frequency range, a fewer total number of points may be used while maintaining acceptable frequency resolution for the psychoacoustic model.

Other technical advantages of the present invention will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which:

FIG. 3 is a block diagram illustrating a portion of the digital audio encoding method illustrated in FIG. 1, showing additional details of one example of steps performed in generating an example psychoacoustic model according to one embodiment of the invention;

FIG. 5 illustrates an application specific integrated circuit fabricated to perform encoding of a digital audio signal according to one embodiment of the teachings of the invention.

DETAILED DESCRIPTION OF INVENTION

An embodiment of the present invention and its advantages are best understood by referring to FIGS. 1 through 5 of the drawings, like numerals being used for like and corresponding parts of the various drawings. The invention relates to encoding of a digital audio signal utilizing psychoacoustic properties to reduce the amount of data required to represent a sound. The invention provides a faster method of encoding a digital audio signal by reducing the amount of computations required during the encoding process. This may be accomplished, at least in part, by performing a number of frequency analyses of the digital audio signal after the digital audio signal has passed through a filter bank, rather than performing one frequency analysis on the original digital audio signal.

Figure 1:
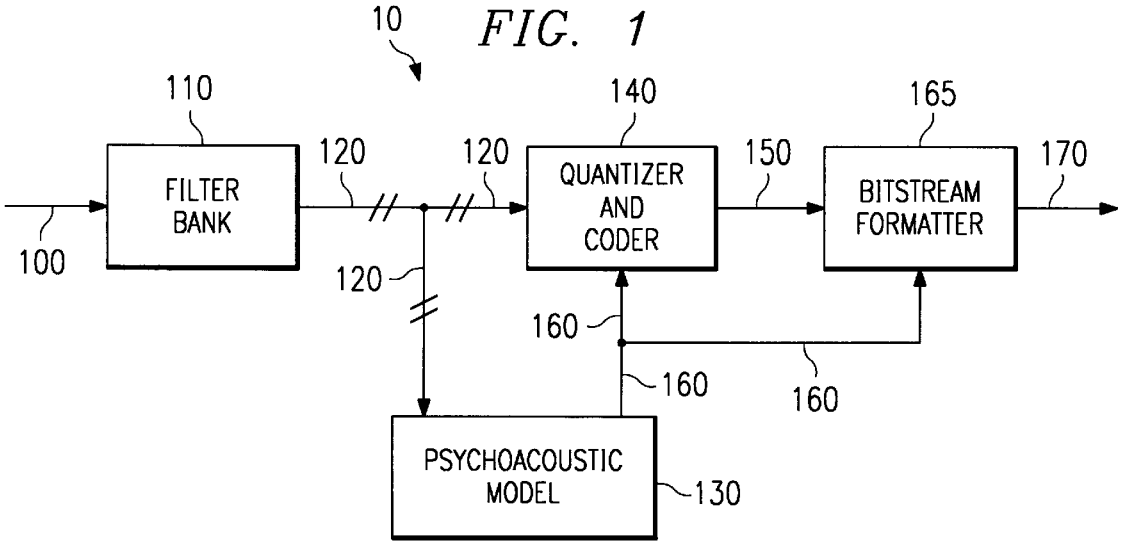
FIG. 1 is a block diagram illustrating one embodiment of a digital audio encoding method according to the teachings of the invention.

FIG. 1 is a block diagram illustrating one embodiment of a digital audio encoding method 10 according to the teachings of the invention. A digital audio input signal 100 is received by a filter bank unit 110. Filter bank unit 110 produces a number of filtered signals 120 that represent digital audio input signal 100. Digital audio input signal 100 may be a digital representation of a continuous audio signal, sampled at a given sampling rate. Example sampling rates include 32 kHz, 44.1 kHz, and 48 kHz; however, other suitable sampling rates may be used. Filtered signals 120 are divided into different frequency ranges by filter bank unit 110. Therefore each filtered signal 120 represents a portion of digital audio input signal 100 that falls within a given frequency range. As described in greater detail below, each filtered signal 120 is allocated a number of bits of data and encoded by a psychoacoustic model unit 130, a quantizer and coder unit 140, and a bitstream formatter unit 165 to produce a digitally-compressed encoded bitstream 170 representing digital audio input signal 100.

Figure 2:
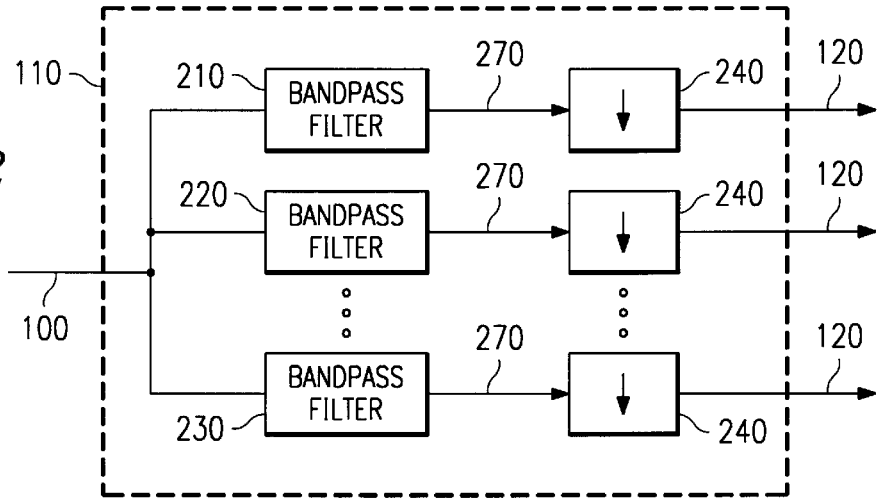
FIG. 2 is a block diagram illustrating a portion of the digital audio encoding method of FIG. 1, showing additional details of a filter bank according to one embodiment of the invention.

Filter bank unit 110 may include a number of bandpass filters of equal bandwidth for separating the digital audio input signal 100 into a number of frequency ranges. This separation is illustrated in FIG. 2. Although any suitable number of bandpass filters may be used, because thirty-two bandpass filters are currently recommended by MPEG standards for filtering a digital audio input, such as digital audio input signal 100, into thirty-two frequency ranges for bit allocation, the use of thirty-two bandpass filters in the present invention is particularly advantageous. The output of each bandpass filter may be subsampled at a rate equal to the original sampling rate divided by the number of filters. Thus, if the original sampling rate was 48 kHz and filter bank unit 110 includes thirty-two bandpass filters, the output of each bandpass filter is subsampled at a rate of 48 kHz/32=1.5 kHz. Because the output of each bandpass filter is subsampled at such a rate, the number of bits of data required for filtered signals 120 is the same as the number of bits received from digital audio input signal 100. Although subsampling may be preferable, subsampling may be omitted without departing from the scope of the invention.

Filtered signals 120 are received by psychoacoustic model unit 130 and quantizer and coder unit 140. Psychoacoustic model unit 130 is used by quantizer and coder unit 140 to efficiently allocate an appropriate number of bits of data to be used to represent each filtered signal 120. A psychoacoustic model is a series of steps performed to generate a psychoacoustic representation of data based on psychoacoustic properties. Psychoacoustic model unit 130 performs the steps associated with a psychoacoustic model. Various psychoacoustic models may be used with the invention. For example, the Motion Pictures Experts Group has developed three types of psychoacoustic models defined as MPEG Layer I, MPEG Layer II, and MPEG Layer III. Each of these types of psychoacoustic models is described in Moving Pictures Expert Group (MPEG) CD 11172-3, entitled "Coding of Moving Pictures and Associated Audio for Digital Storage Media at up to About 1.5 MBIT/S: Part 3 Audio." Psychoacoustic model unit 130 analyzes filtered signals 120 and creates a set of data to control quantization, or bit allocation, and coding of filtered signals 120 by quantizer and coder unit 140. In one embodiment, psychoacoustic model unit 130 calculates a signal-to-mask ratio for each filtered signal 120 and provides a signal-to-mask ratio 160 for each filtered signal 120 to quantizer and coder unit 140. A signal-to-mask ratio is the ratio of the signal strength to masking threshold. A masking threshold is a function below which an audio signal cannot be perceived by the human auditory system. Signal-to-mask ratios 160 may be used by quantizer and coder unit 140 to efficiently allocate an appropriate a number of bits to each filtered signal 120. Signal-to-mask ratios 160 are an example of a psychoacoustic representation of digital audio input signal 100.

Quantizer and coder unit 140 receives filtered signals 120 and signal-to-mask ratios 160 and allocates an appropriate number of bits assigned to each filtered signals 120 based on signal-to-mask ratios 160. Quantizer and coder unit 140 produces quantized samples 150. Quantized samples 150 are received by bitstream formatter unit 165, which encodes and formats the quantized samples 150 to produce a digitally-compressed encoded bitstream 170 representing digital audio input signal 100. Bitstream formatter unit 165 may also produce header information, error detection information, and other information that may be useful in decoding digitally-compressed encoded bitstream 170. Examples of a filter bank, a psychoacoustic model, a quantizer and coder, and a bitstream formatter may be found in MPEG CD 11172-3, entitled "Coding of Moving Pictures and Associated Audio for Digital Storage Media at Up to About 1.5 MBIT/s: Part 3 Audio."

A frequency representation of digital audio input signal 100 is conventionally generated for use by a psychoacoustic model. Conventionally, such a frequency representation is generated through performing a frequency analysis on digital audio input signal 100. However, according to the invention, a frequency analysis of each filtered signal 120 is performed to obtain a frequency representation of digital audio input signal 100 for use by the psychoacoustic model. Performing a frequency analysis on each filtered signal 120 may reduce the number of computations required to obtain a frequency representation of digital audio input signal 100 and therefore may reduce the time required to perform the encoding process.

FIG. 2 is a block diagram illustrating a portion of the digital audio encoding method 10 of FIG. 1, showing additional details of the filter bank unit 110 in accordance with one embodiment of the invention. Filter bank 110 may include thirty-two bandpass filters 210, 220, 230 of equal bandwidth to conform to requirements imposed by MPEG for certain encoding methods. However, a suitable alternative number of bandpass filters of equal or unequal bandwidth may be used. The use of thirty-two bandpass filters may be particularly advantageous because MPEG currently recommends thirty-two bandpass filters for filtering a digital audio input for bit allocation. Thus, the present invention may be implemented without any disadvantage that may arise from additional filtering of a digital audio input signal. In FIG. 2, each bandpass filter 210, 220, 230 receives digital audio input signal 100. The output of each bandpass filter 210, 220, 230 is a filtered digital audio signal 270. Each filtered digital audio signal 270 may then be subsampled by subsamplers 240 to reduce the total number of bits required by filtered signals 120. In the embodiment shown in FIG. 2, filter bank unit 110 produces thirty-two filtered signals 120, each falling within a separate frequency range. These filtered signals 120 are received by psychoacoustic model unit 130 and by quantizer and coder unit 140.

FIG. 3 is a block diagram illustrating a portion of digital audio encoding method 10 illustrated in FIG. 1, showing additional details of one example of steps performed by psychoacoustic model unit 130. A psychoacoustic model is used to determine the distribution of bits that should be applied to each filtered signal 120. As described previously, a psychoacoustic model may base the distribution of bits on both masking of certain frequencies and on the increased sensitivity of the human ear to lower frequencies.

The steps illustrated in FIG. 3 may be incorporated in MPEG Layer I or II psychoacoustic models or modified in an MPEG Layer III psychoacoustic model. Other psychoacoustic models that utilize a frequency representation of the data to be encoded may also be used without departing from the scope of the invention. A psychoacoustic model may include a step 310 of generating a frequency representation of digital audio input signal 100. Conventionally, such a frequency representation is generated by performing a fast Fourier transform directly on digital audio input signal 100 with a 512 point fast Fourier transform utilized for MPEG Layer I and a 1024 point Fourier transform utilized for MPEG Layers II and III. According to the teachings of the invention, a frequency representation of digital audio input signal 100 may be obtained by performing a frequency analysis on each filtered signal 120. Performing a frequency analysis of each filtered signal 120 may reduce the number of computations required and therefore may reduce the time required to perform the encoding process.

Additional steps associated with a psychoacoustic model may include a step 320 of determining a sound pressure level for each filtered signal 120, a step 330 of determining an absolute threshold for a number of the frequencies in digital audio input signal 100, a step 340 of finding the tonal and non-tonal components of digital audio input signal 100, a step 350 of decimating maskers to obtain only the relevant maskers, a step 360 of calculating an individual masking threshold for a number of the frequencies contained in digital audio input signal 100, a step 370 of determining a global masking threshold for digital audio input signal 100, a step 380 of determining a minimum masking threshold for each filtered signal 120, and a step 390 of calculating a signal-to-mask ratio for each filtered signal 120.

Each of these steps 320, 330, 340, 350, 360, 370, 380, and 390 either directly or indirectly requires a frequency representation of digital audio input signal 100, which according to the teachings of the invention may be generated based on a frequency analysis of filtered signals 120. These example steps are described in greater detail below; however, additional information concerning each of these example steps that may be used in one example of a psychoacoustic model may be found in MPEG CD 11172-3, entitled "Coding of Moving Pictures and Associated Audio for Digital Storage Media at Up to About 1.5 MBITIs: Part 3 Audio."

Step 320 may include determining a sound pressure level for each filtered signal 120. A sound pressure level is used in a later step to calculate a masking threshold for selected frequencies. Step 320 may utilize the result of step 310, which is a frequency representation of digital audio input signal 100. A psychoacoustic model may also include step 330 of determining an absolute threshold, also known as threshold in quiet, for particular frequencies in certain filtered signals 120. In this embodiment, for which frequencies an absolute threshold is calculated depends upon whether MPEG Layer I, II, or III is utilized. The absolute threshold is used in decimation of maskers, discussed below. Step 340 of finding the tonal and non-tonal components for digital audio input signal 100 may also be incorporated. A tonal component is a sinusoid-like component of an audio signal, and a non-tonal component is a noise-like component of an audio signal. Because the tonality of a masking component has an influence on a masking threshold, differentiating between tonal and non-tonal components may be desirable. Step 350 of decimating maskers to obtain only the relevant maskers may also be performed. Decimation is a procedure that is used to reduce the number of maskers that are considered for calculation of a global masking threshold. Decimation of tonal and non-tonal components may be based on the absolute threshold at the frequency of the tonal or non-tonal component, as well as the proximity of one component to other components.

Step 360 of calculating an individual masking threshold for a number of the frequencies contained in digital audio input signal 100 may be incorporated in a psychoacoustic model. A global masking threshold may be calculated at step 370 based on the individual masking thresholds. A global masking threshold is a masking threshold for an entire input signal that is based on the interaction of the individual masking thresholds with each other. Step 380 of determining a minimum masking threshold for each frequency range may then be performed based on the global masking threshold. A minimum masking threshold for each filtered signal 120 is calculated in order to calculate a signal-to-mask ratio 160 for each filtered signal 120. Step 390 of calculating a signal-to-mask ratio 160 for each filtered signal 120 may then be performed based on the minimum masking threshold for each filtered signal 120 and also based on the sound pressure level of each filtered signal 120. Bit allocation by quantizer and coder unit 140 of filtered signals 120 is performed based on the signal-to-mask ratio 160 for each filtered signal 120. Other psychoacoustic models may include additional or different steps to produce a psychoacoustic representation of digital audio input signal 100 to facilitate appropriate allocation of bits to each filtered signal 120.

The above steps utilize, either directly or indirectly, a frequency representation of digital audio input signal 100. Performing a frequency analysis on each of the filtered signals 120 to provide a frequency representation of digital audio input signal 100 rather than performing one frequency analysis on digital audio input signal 100 reduces the number of calculations required to obtain a frequency representation of digital audio input signal 100. For example, the number of calculations required for an N-point fast Fourier transform is proportional to N log(N). Therefore, the total number of calculations required for a thirty-two point fast Fourier transform of each of the thirty-two bandpass filters is proportional to 32*32*log(32). By contrast, the total number of calculations required for a 1024 point fast Fourier transform of digital audio input signal 100 is proportional 1024*log(1024). Thus, fewer calculations are required to obtain a 1024 point frequency analysis of digital audio input signals 100 if the frequency analysis is split, for example, into thirty-two separate frequency analyses of the output of filter bank unit 110, each separate frequency analysis being a thirty-two point fast Fourier transform. Although fewer calculations are required, the resolution provided by thirty-two, thirty-two point frequency analyses is similar to that provided by one 1024 point frequency analysis.

Further gains in computational speed may be obtained through reducing the number of points used for frequency analysis of filtered signals 120 in higher frequency ranges. Because higher frequencies are not perceived by the human ear as readily as lower frequencies, the frequency representation used by the psychoacoustic model of these higher frequency ranges may be represented with less resolution than the lower frequency ranges. By contrast, a frequency analysis of digital audio input signal 100 would provide the same frequency resolution at lower frequencies as at higher frequencies. Therefore, frequency analyses of filtered signals 120 at higher frequency ranges may be performed, for example, with only two or four points, which further reduces the total number of calculations, and therefore encoding time. Only one point may be sufficient to represent the highest frequency range of the filtered signals 120. In this example, thirty-two points may be used for frequency analyses at the lowest frequencies with a decline in the number of points used for greater frequencies. Thus, a frequency representation of digital audio input signal 100 may be based on a number of frequency analyses of filtered signals 120 with the number of points used for the frequency analyses including, for example, 32, 16, 8, 4, 2, and 1 point.

Figure 4:
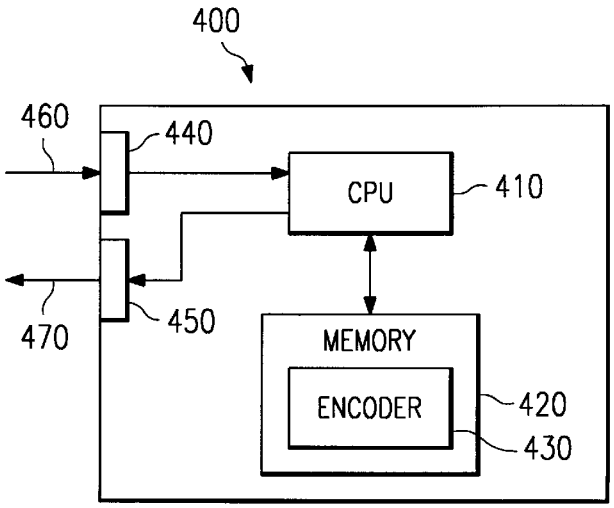
FIG. 4 is a block diagram illustrating a digital signal processor storing programming for encoding a digital audio signal according to one embodiment of the teachings of the invention.

The invention may be implemented in many forms, including a digital signal processor, an application specific integrated circuit, through executing software on a computer, or other suitable techniques. FIG. 4 is a block diagram illustrating a digital signal processor storing programming for encoding a digital audio signal according to the teachings of the invention. A digital signal processor 400 includes a central processing unit 410 connected to a memory system 420. Central processing unit 410 is operable to execute programming stored in memory system 420. Encoder programming 430 stored in memory system 420 includes programming operable to perform the steps of encoding according to the invention as described above. Digital signal processor 400 may also include an input port 440 and an output port 450 for interfacing digital signal processor 400 with other devices (not explicitly shown). In operation, a digital audio input signal 460 may be received at input port 440 for encoding. Central processing unit 410 executes encoder programming 430 and encodes the digital audio input signal 460, as described above, to produce a digitally-compressed encoded bitstream 470 representing digital audio input signal 460.

FIG. 5 illustrates an application specific integrated circuit 500 fabricated to perform encoding of a digital audio signal according to the teachings of the invention. FIG. 5 illustrates functional units 510, 530, 540, and 565 which perform the encoding functions according to the invention. Application specific integrated circuit 500 includes a filter bank unit 510, a psychoacoustic model unit 530, and quantizing and coding unit 540, and a bitstream formatting unit 565. Filter bank unit 510, psychoacoustic model unit 530, quantizing and coding unit 540, and bitstream formatting unit 565 may be analogous to filter bank unit 110, psychoacoustic model unit 130, quantizer and coder unit 140, and bitstream formatter unit 165, respectively. Each unit may be self-contained, as shown, interconnected with the other units, or formed through other suitable methods. Application specific integrated circuit 500 may also include an input port 580 and an output port 590 for interfacing with other devices (not explicitly shown). Application specific integrated circuit 500 receives a digital audio input signal 506, which is analogous to digital audio input signal 100, and produces a digitally-compressed encoded bitstream 570 representing digital audio input signal 506.

Although the present invention and its advantages have been described in detail, it should be understood that various changes, substitutions, and alterations can be made hereto without departing from the spirit and scope of the invention as defined by the following claims.

What is claimed is:

1. A method for encoding a digital audio signal, the method comprising the steps of:

filtering a portion of the digital audio signal into a first number of frequency ranges to produce a respective first number of filtered signals;

performing a discrete frequency analysis on each of the first number of filtered signals to produce a frequency representation of the digital audio signal by performing an N point frequency analysis of a first portion of the first number of frequency ranges and an M point frequency analysis on a second portion of the first number of frequency ranges, M being different from N;

generating a psychoacoustic representation of the digital audio signal based on the frequency representation of the digital audio signal; and formatting the first number of filtered signals based on the psychoacoustic representation of the digital audio signal to produce a digitally-compressed encoded bit stream representing a portion of the digital audio signal.

2. The method for encoding a digital audio signal of claim 1, wherein:

said step of performing a discrete frequency analysis whereby said first portion of the first number of frequency ranges have a lower frequency than said second portion of the first number of frequency ranges.

3. A digital signal processor for encoding digital audio input, the processor comprising:

a central processing unit; and a memory system accessible by the central processing unit, the memory system storing encoding programming operable to be executed by the central processing unit, the encoding programming further operable to;

filter a portion of the digital audio input into a first number of frequency ranges to produce a respective first number of filtered signals;

perform a discrete frequency analysis on each of the first number of filtered signals to produce a frequency representation for the digital audio input by performing an N-point frequency analysis of each filtered signal in a first portion of the first number of filtered signals and an M-point frequency analysis of each filtered signal in a second portion of the first number of filtered signals, M being different from N;

generate a psychoacoustic representation of the digital audio input based on the frequency representation of the digital audio input; and format the first number of filtered signals based on a psychoacoustic representation to produce a digitally-compressed encoded bit stream representing a portion of the digital audio input.

4. The digital signal processor of claim 3, wherein:

the encoding programming is further operable whereby said first portion of the first number of frequency ranges have a lower frequency than said second portion of the first number of frequency ranges.

5. An integrated circuit for encoding digital input, the integrated circuit comprising:

a filtering unit operable to filter a portion of the digital input into a first number of frequency ranges to produce a respective first number of filtered signals;

a frequency analysis unit operable to perform a discrete frequency analysis on each of the first number of filtered signals to produce a frequency representation of the digital input, said frequency analysis unit operable to perform an N-point frequency analysis on each filtered signal in a first portion of the first number of frequency ranges, and perform an M-point frequency analysis on each filtered signal in a second portion of the first number of filtered signals, M being different from N;

a psychoacoustic model unit operable to generate a psychoacoustic representation of the digital input based on the frequency representation of the digital input; and a formatting unit operable to format the first number of filtered signals based on the psychoacoustic representation of the digital input to produce a digitally-compressed encoded bit stream representing a portion of the digital input.

6. The integrated circuit of claim 5, wherein:

said frequency analysis whereby said first portion of the first number of frequency ranges have a lower frequency than said second portion of the first number of frequency ranges.

* * * * *